United States Patent [19]

Chung et al.

[11] Patent Number: 5,007,958

[45] Date of Patent: Apr. 16, 1991

[54] LIME-BASED INJECTION POWDER FOR STEEL-REFINING

[75] Inventors: Yeong-Huei Chung, Kaohsiung; Der-Shyang Cheng, Kaohsiung Hsien, both of Taiwan

[73] Assignee: China Steel Corporation, Kaohsiung, Taiwan

[21] Appl. No.: 476,791

[22] Filed: Feb. 8, 1990

[51] Int. Cl.[5] ..... C21C 7/02; C21C 7/04

[52] U.S. Cl. ..... 75/330; 75/507; 75/528; 75/539; 75/558; 75/560; 75/568; 75/570

[58] Field of Search ..... 71/64.12; 423/175, 637, 423/432, 267, 636; 75/570, 539, 568, 558, 559, 527, 560, 507, 528, 330

[56] References Cited

U.S. PATENT DOCUMENTS 4,154,606 5/1979 Freissmuth et al. ..... 75/558

OTHER PUBLICATIONS

D. R. Glasson, "Reactivity of Lime and Related Oxides, IV, Carbonatation of Lime", *J. Appl. Chem.*, 10, Jan. 1960, pp. 42–48.

*Primary Examiner*—R. Dean
*Assistant Examiner*—Robert R. Koehler
*Attorney, Agent, or Firm*—Ladas & Parry

[57] ABSTRACT

A lime-based injection powder for use in steel-refining, having excellent waterproofing and desulphurization effects, consists of (a) more than 65% by weight of calcium oxide, (b) less than 30% by weight of fluorite, and 5–10% by weight of Al powder, 5%–7% by weight of the calcium oxide being converted into CaCO3 by reacting the calcium oxide with carbon dioxide in a multi-stage fluidized bed reactor.

2 Claims, 6 Drawing Sheets

LIME-BASED INJECTION POWDER FOR STEEL-REFINING

BACKGROUND OF THE INVENTION

This invention relates to an injection powder used in refining steel, and particularly to a lime-based injection powder consisting of carbon dioxide treated CaO, $CaF_2$ and Al.

It is known that sulphur and oxygen inclusions in steels affect adversely steel refining processes and the mechanical properties of steel such as low temperature toughness, drawability, etc. Generally, in order to improve the quality of steel, the sulphur and oxygen inclusions in steel must be eliminated as completely as possible and the inclusion morphology must be controlled. Lime-based injection powders are commonly used in the manufacture of steel so as to improve the cleanliness, the inclusion morphology and the mechanical properties of the steel.

Quick lime is a known desulphurizing substance which has strong hygroscopic properties and thus is readily reacts with the atmospheric moisture. The moist quick lime has the following disadvantages: (1) the flowability of the powder is poor and thus difficulties are created in the injection operation, for instance, severe blockade is caused in the pipes used for injection; (2) the moisture content contained in the quick lime decomposes readily according to the following equation:

$$H_2O \rightarrow 2H + O$$

When the moist quick lime is introduced into a molten steel, it increases the amount of H and O in the steel and thus affects adversely the quality of the steel; (3) The increased oxygen content lowers the efficiency of the desulphurization of the injection powder. To prevent the quick lime from absorbing moisture, the quick lime may be used immediately after calcination or reheated in a drying furnace at a sufficiently high temperature before injection. However, it is practically difficult in most case due to the problems in necessary equipment. Therefore, it is desirable to provide a lime-based injection powder which does not absorb moisture for a prolonged storage period, particularly in an area of high humidity.

SUMMARY OF THE INVENTION

An object of the invention is to provide a lime-based injection powder which has excellent water-resistance and desulphurizing effects to be used in steel refining.

According to the present invention, the lime-based injection powder for use in steel refining processes, which has excellent water-resistance and desulphurization effects, consists of (a) more than 65% by weight of calcium oxide, (b) less than 30% by weight of fluorite, and 5–10% by weight of Al powder, 5%–7% by weight of the calcium oxide is converted into CaCO3 by reacting the calcium oxide with carbon dioxide.

DETAILED DESCRIPTION OF THE PREFERRED EMBODIMENT

The lime-based injection powder according to the present invention is used in refining steel. Calcium oxide is used for desulphurizing steel. The source of calcium oxide is limestone which, after being calcined, is decomposed into calcium oxide (quick lime) and carbon dioxide. Calcium oxide is a strong hygroscopic substance which reacts readily with the moisture in the atmosphere and forms into calcium hydroxide. When the moist calcium oxide is injected into a molten steel, it decomposes and increases the amount of hydrogen and oxygen in the steel, thereby adversely affecting the efficiency of desulphurization. To prevent calcium oxide from absorbing moisture in the atmosphere, calcium oxide formed after the calcination of limestone is brought to react with carbon dioxide at appropriate temperatures so as to partially convert calcium oxide into calcium carbonate, i.e. to form protective CaCO3 layers on the particles of calcium oxide. The protective calcium carbonate layer can prevent calcium oxide from contacting and reacting with the atmospheric moisture.

Figure 1:
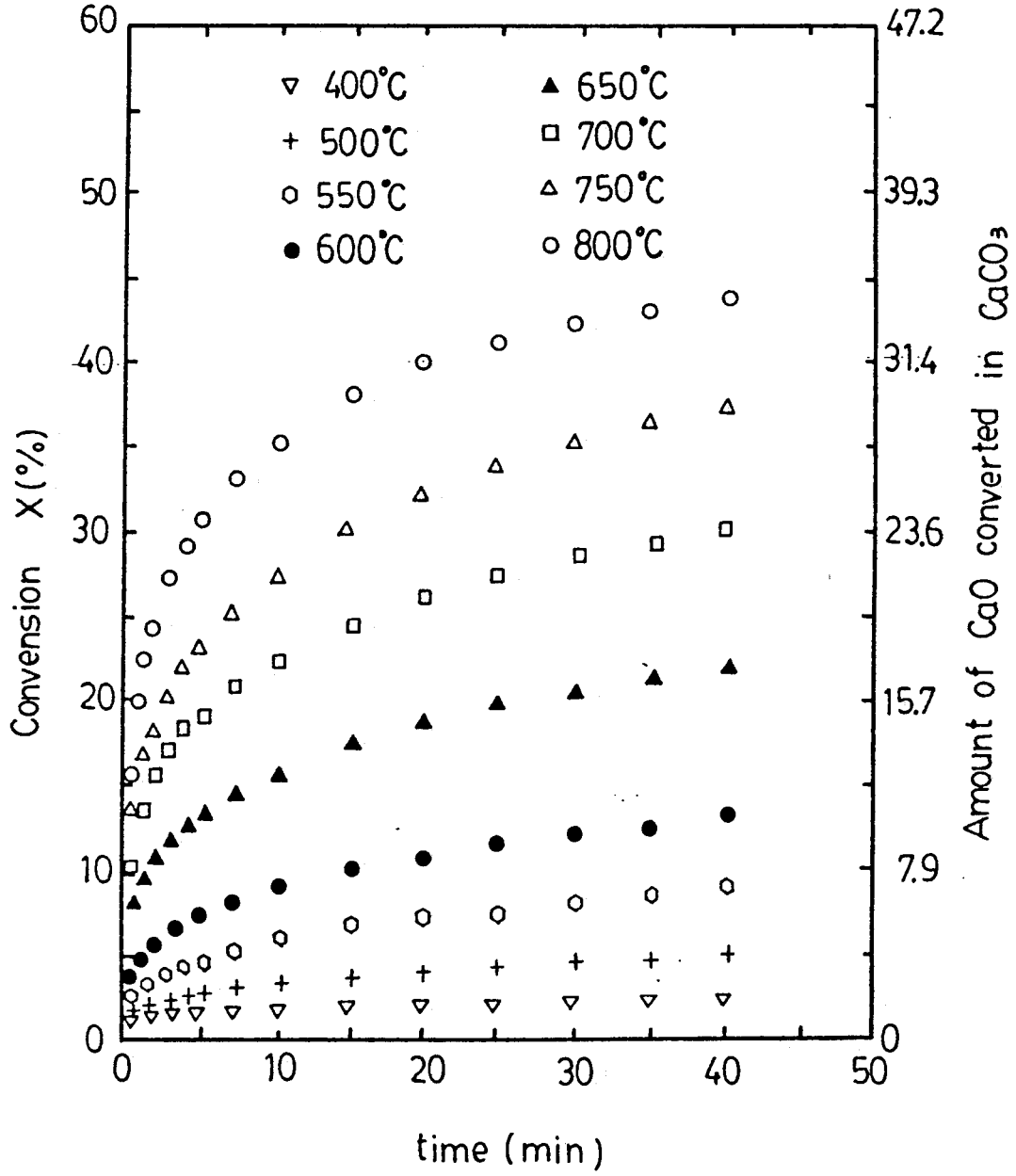
FIG. 1 is a graph which shows the relation between the percentage of conversion of CaO, the time of reaction and the reaction temperatures.

FIG. 1 shows the results of the experiments which were conducted to investigate the relation between the percentage of conversion of the carbon dioxide-treated CaO, the temperature at which CaO reacts with carbon dioxide, and the time of the reaction. It can be noted that the degree of conversion increases as the temperature increases.

Figure 2:
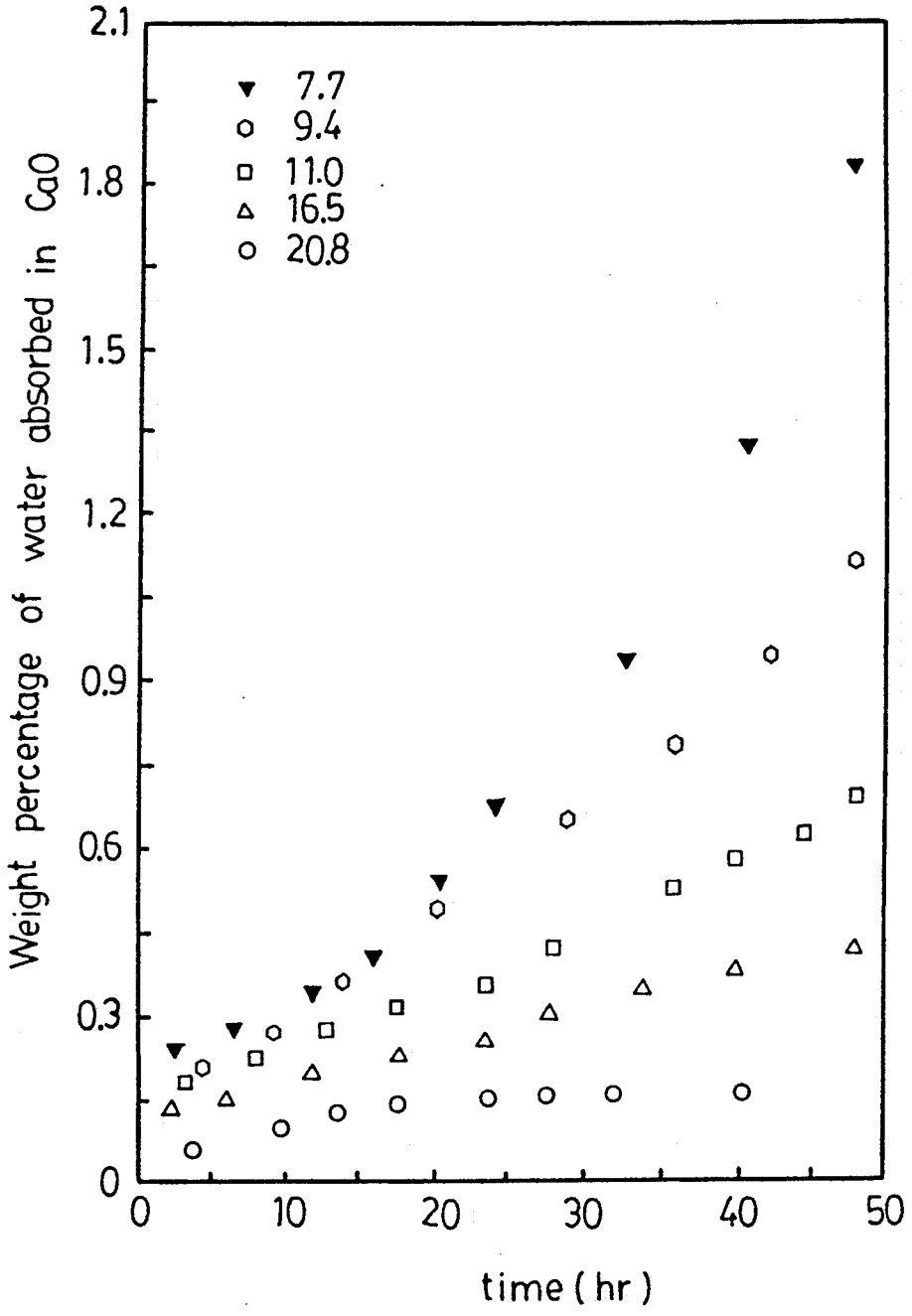
FIG. 2 is a diagram which shows the absorptivity of CaO after it is partially converted into CaCO3.

FIG. 2 shows the relation between the percentage of conversion and the moisture absorbency of CaO at 25°±2° C. and the relative humidity of 90%.

The amount of CaO used in the composition of the present invention is limited to the amount more than 65%. The particle-size of CaO is preferably about 0.5–1.0 mm. For economy, the percentage of CaO to be converted into CaCO3 is limited to 5%–7% by weight based on the weight of CaO. By experiments, it was found that the CaO with this conversion percentage still performs a good moistureproofing effect after it was stored for one month.

Fluorite is used in the present invention for the purpose of accelerating the slagging action in refining steel. The amount of fluorite used is limited to an amount less than 30% by weight based on the total weight of the injection powder because of its corrosion to the ladle refractory.

Aluminum is used for the purpose of removing the oxygen generated from the following desulphurization reaction of CaO:

$$S + CaO \rightarrow CaS + O$$

From the above reaction, it can be appreciated that the desulphurization is efficient when oxygen is removed from the reaction product. Since aluminum reacts with the active oxygen produced from the desulphurization, it enhances the desulphurization reaction. For economy, the amount of Al used in the composition of the present invention is limited to 5%-10% by weight based on the total weight of the injection powder. Although this amount is low, it is practically effective for enhancing desulphurization.

In order to better enable the artisan to practice the present invention the following examples are provided by of illustration and not by way of limitation.

EXAMPLE 1

Figure 3:
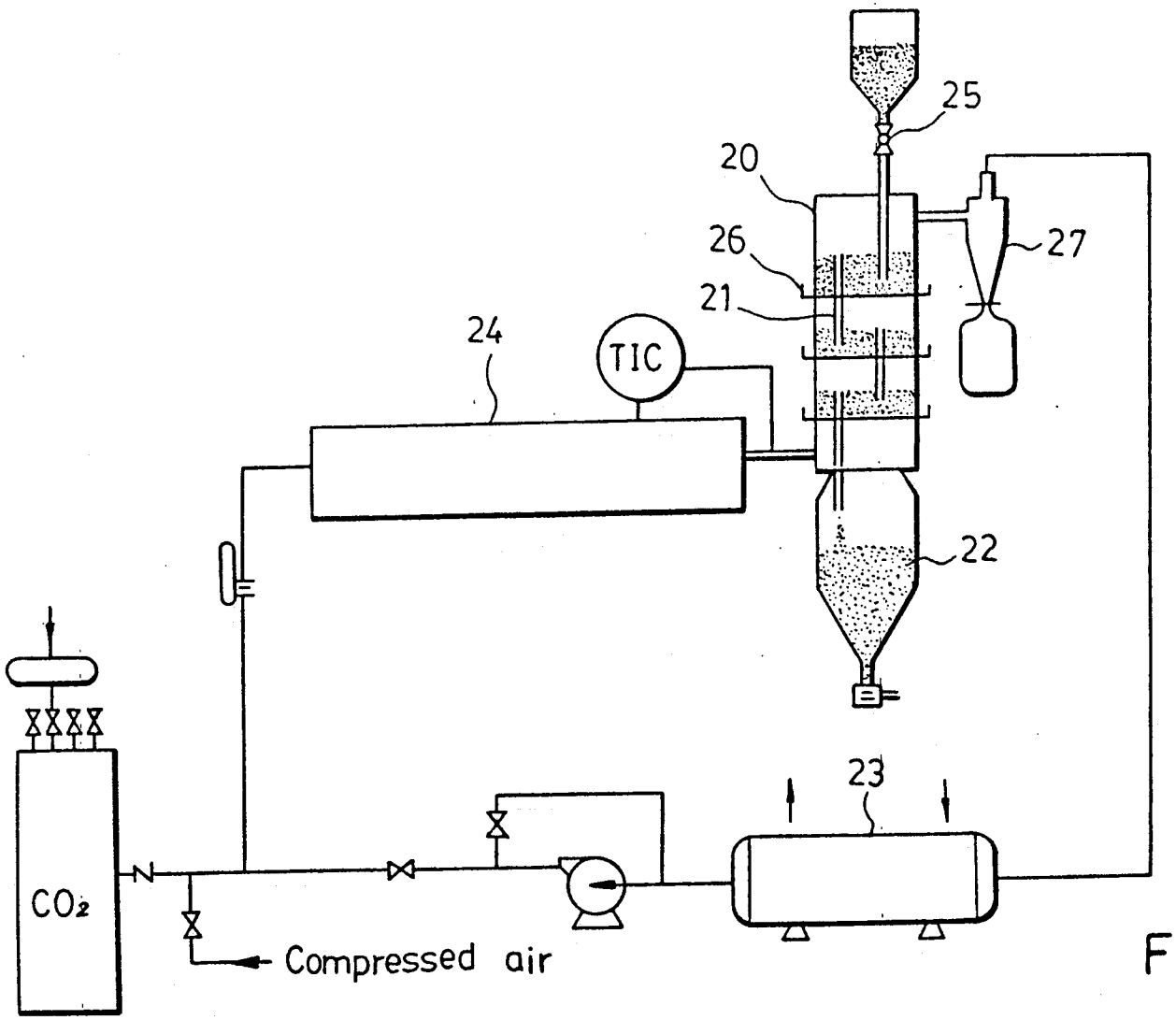
FIG. 3 is a schematic diagram showing an apparatus including a fluidized bed reactor for treating CaO with carbon dioxide.

Limestone was calcined in a rotary kiln at 900 degrees C. The quick lime obtained contained 80%-95% by weight of CaO and the remaining substances were H2O, CO2, SiO2, Al2O3, MgO, etc. The particle size of the quick lime was 0.125-1.0 mm. The quick lime was brought to react with carbon dioxide at different temperatures in a multi-stage fluidized bed reactor shown in FIG. 3. CaO was fed from a rotary feeder 25 to a multi-stage fluidized bed reactor 20 and treated with carbon dioxide which flowed from a heater 24. The reactor 20 included perforated trays 26 and conduits 21 extending from one tray to the other. The treated CaO was discharged to a storage tank 22. Carbon dioxide coming out from the reactor 20 was passed through a cyclone separator 27 and a cooler 23 and resent to the heater 24. The percentages of conversion were determined by using a thermal gravitation analysis system. Tests were conducted on the moisture absorbency of some representative samples.

EXAMPLE 2

The quick lime produced from the above-mentioned multistage fluidized bed reactor was directly mixed with fluorite (CaF2) and aluminum in accordance with the ratios limited by the present invention and used as injection powders. In refining steel, the samples of the injection powders were injected into steel containers by using argon as a carrier gas. After injection, samples of the molten steel were taken and subjected to chemical analysis.

From the chemical analysis, it was found that, when using the injection powder according to the present invention in refining steel, the amount of hydrogen increased after injection was only 1-2 ppm. Some other results of the analysis are shown in FIGS. 4 and 5.

Figure 4:
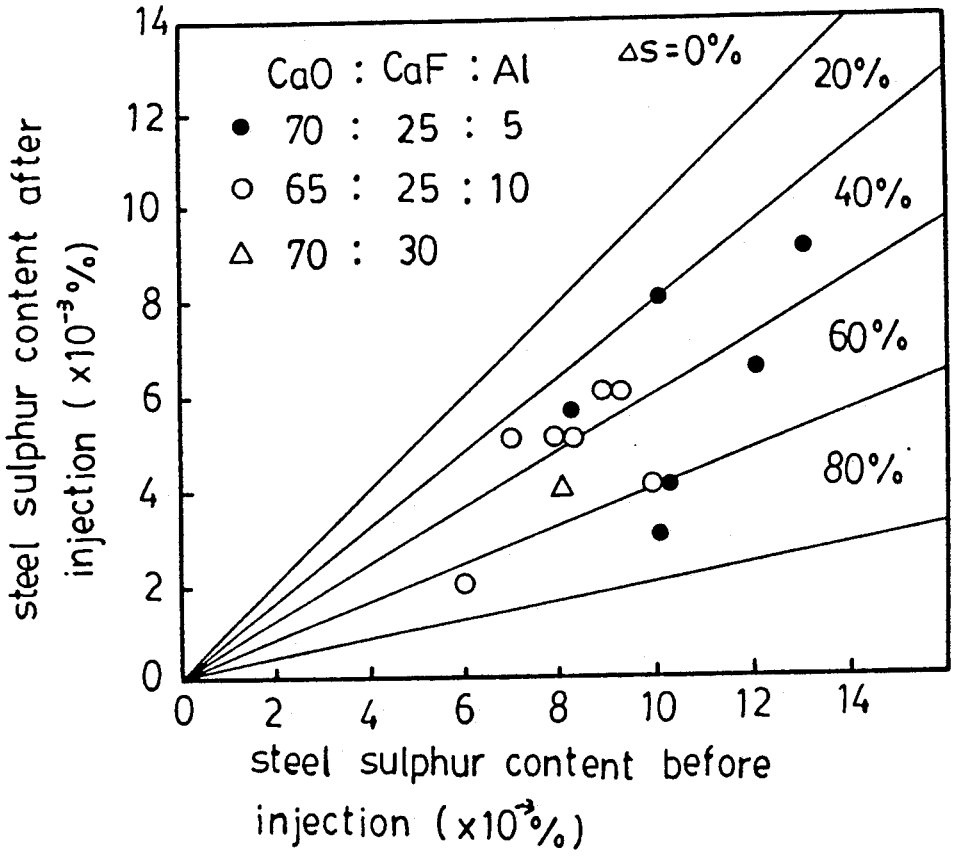
FIG. 4 is a diagram which compares the desulphurization effects of the injection powders prepared according to the present invention and according to the prior art.

FIG. 4 shows the results of the experiments on the desulphurization effects of three different injection powders. From FIG. 4, it can be seen that the degree of desulphurization ranges from 30% to 80%. Even at a low initial sulphur content, the injection powder of the present invention provides a desulphurizing effect that maintains a satisfactory final sulphur content in the steel.

Figure 5:
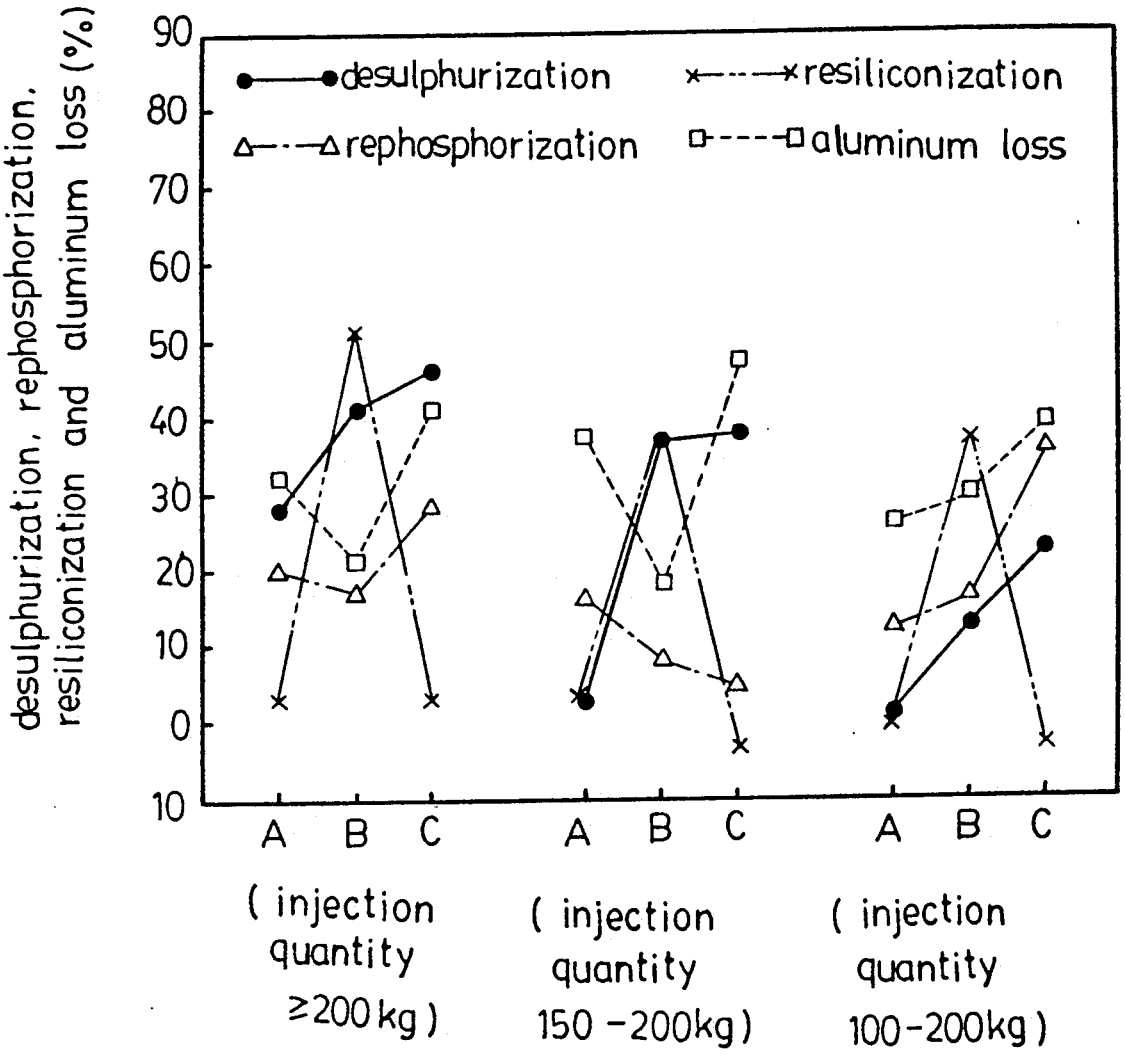
FIG. 5 is another diagram which compares the effects of known injection powders and the injection powder of the present invention.

FIG. 5 shows the results of the experiments of desulphurization using Control (A) having 80% CaO which was not treated with carbon dioxide and 20% by weight of CaF2, Control (B) consisting of CaSi, and Powder (C) of the present invention consisting of 70% by weight of CaO, 25% by weight of CaF2 and 5% by weight of Al. The results show the percentages of sulphur removed, of phosphorous restoration, of silicon restoration, and of aluminum loss. From FIG. 5, it can be appreciated that the injection powder (C) exhibits better desulphurization efficiency than the controls and shows no silicon restoration.

EXAMPLE 3

Figure 6:
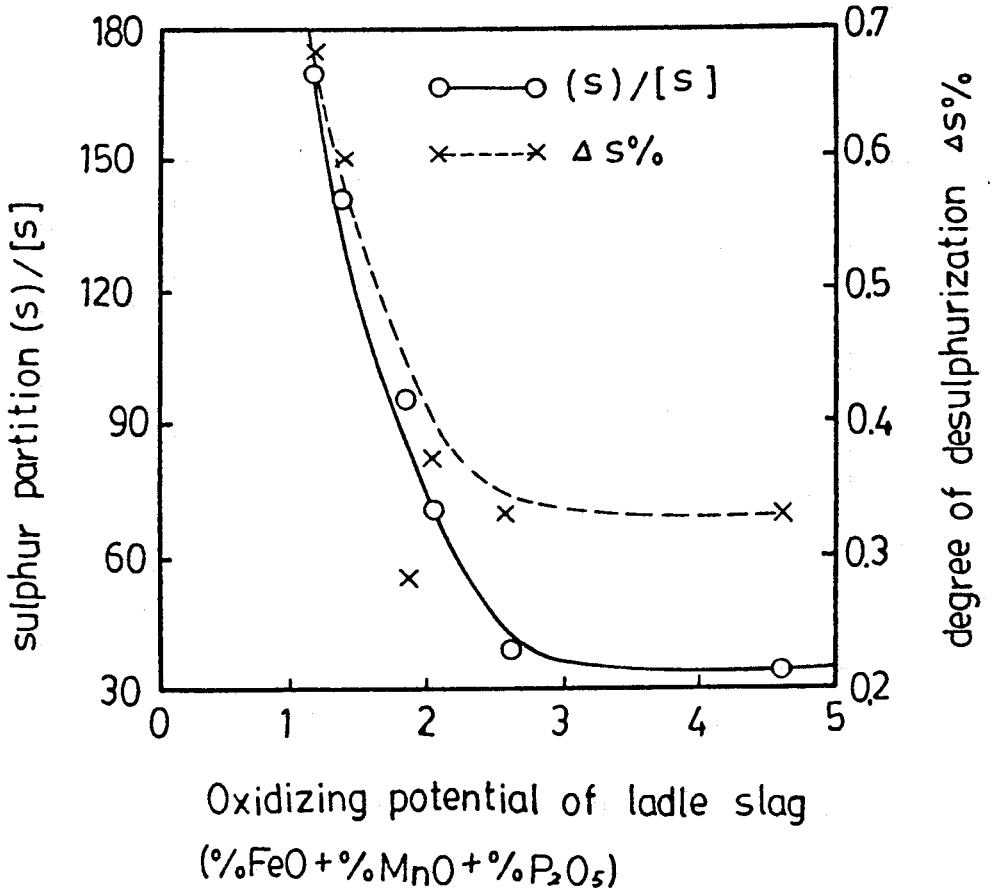
FIG. 6 is a diagram which shows the effect of the top slag on the injection powder of the present invention.

Experiments were made to investigate the influence of top slags on the desulphurization of the injection powder of the present invention. From the experiments, it was noted that the amounts of FeO, MnO and P2O5 in the top slag must be low so as to enhance the efficiency of desulphurization of the injection powder. FIG. 6 shows the relation between the degree of desulphurization (ΔS %) and sulphur partition (S)/[S] with respect to oxidizing potential of top slag. To achieve a good desulphurization efficiency, the sum of the percentages of FeO, MnO and P2O5 should be maintained at a value of less than 1.5%.

With the invention thus explained, it is apparent that numerous variations and modifications can be made with departing from the scope of the invention. It is therefore intended that the invention be limited only as indicated in the appended claims.

What I claim is:

1. A method of making a lime-based injection powder for use in a steel-refining, said powder having excellent waterproofing and desulphurization effects, the method comprising the steps of preparing a powder which consists of (a) more than 65% by weight of calcium oxide, (b) less than 30% by weight of fluorite, and 5-10% by weight of Al powder, and converting 5%-7% by weight of the calcium oxide into CaCO3 by reacting the calcium oxide with carbon dioxide.

2. A method as claimed in claim 1, wherein calcium oxide is reacted with carbon dioxide in a multi-stage fluidized bed reactor.

* * * * *